US006055823A

United States Patent [19]

Baker et al.

[11] Patent Number: 6,055,823

[45] Date of Patent: May 2, 2000

[54] MODULAR REFRESHMENT CENTER FOR REFRIGERATOR FRESH FOOD COMPARTMENT

[75] Inventors: Phillip D. Baker, Louisville, Ky.; Gordon Turner Walker, Midlothian, Va.; Dennis Paul Matz, Louisville, Ky.; Gerald Lee Mitchell, Louisville, Ky.; Joseph Murphy Miller, Louisville, Ky.; Charles William Nelson, Louisville, Ky.; Bruce Lloyd Ruark, Louisville, Ky.; Jerry Clyde Martin, Louisville, Ky.; Michael Joseph McCauley, Louisville, Ky.; John Joseph Domagala, Louisville, Ky.; Duane Jubenville, Louisville, Ky.; Michael Stephen Csernik, Louisville, Ky.; Mark Walter Steiner, Louisville, Ky.

[73] Assignee: General Electric Company, Louisville, Ky.

[21] Appl. No.: 09/106,626

[22] Filed: Jun. 29, 1998

Related U.S. Application Data

[60] Provisional application No. 60/051,743, Jul. 3, 1997.

[51] Int. Cl.[7] ..... F25D 23/02; F25D 11/02; A47B 96/04

[52] U.S. Cl. ..... 62/265; 62/441; 312/404

[58] Field of Search ..... 62/407, 408, 265, 62/441; 312/401, 403, 404, 405.1, 321.5; 200/61.62

[56] References Cited

U.S. PATENT DOCUMENTS

| | | | |
|---|---|---|---|
| 2,656,688 | 10/1953 | Hinkel | 312/401 |
| 3,218,111 | 11/1965 | Steiner | 312/401 |
| 4,586,347 | 5/1986 | McCarty | 62/265 |
| 5,209,082 | 5/1993 | Ha | 62/265 |

*Primary Examiner*—William Doerrler
*Attorney, Agent, or Firm*—H. Neil Houser

[57] ABSTRACT

A refreshment center having a modular construction and including a mini door and a frame is described. The mini door is fabricated and assembled separate from the frame, and the mini door includes a hinge system and a trigger. The mini door provides quick and convenient access to the refreshment center by being simple and easy to open and close. The frame, in an exemplary embodiment, is a one piece plastic molded part which serves as the main structural member of the assembly. The frame includes first and second spaced apart planar members, and further includes a keeper slot and a keeper for being inserted within the slot. The keeper extends from the slot and at least partially through a keeper slot in the door trim. The frame further includes a switch cavity for housing at least a portion of a switch assembly. A switch bracket is provided to be secured over the switch cavity and is engaged to the frame by a screw. The mini door is secured to the frame by a hinge system which includes a hinge arm which extends between, and is secured to, the mini door and the frame. More specifically, at the frame, the hinge arm is secured to a slide located between the frame first and second planar members. Hinge pins are secured to the mini door outer door member and extend from the outer door member and through the bushings of pivot slides. The pivot slides are secured to the frame by retainers, and springs are provided to maintain the pivot slides in position within the retainer. The switch assembly includes a switch having a switch actuator arm. Wires extend from the switch to a harness which mates with a receptacle. The receptacle is in electric circuit with a light in the fresh food compartment. The light used to illuminate the refreshment center can be one of the existing lights used in current side-by-side refrigerators since the inner cover is transparent.

31 Claims, 6 Drawing Sheets

MODULAR REFRESHMENT CENTER FOR REFRIGERATOR FRESH FOOD COMPARTMENT

CROSS REFERENCE TO RELATED APPLICATION

This application claims the benefit of U.S. Provisional Application No. 60/051,743, filed Jul. 3, 1997.

FIELD OF THE INVENTION

This invention relates generally to household refrigerators and more particularly, to a refreshment centers accessible through a mini door in the main door of a refrigerator fresh food compartment.

BACKGROUND OF THE INVENTION

Side-by-side household refrigerators include a fresh food storage compartment and a freezer storage compartment. Each storage compartment has a front access opening normally closed by a fresh food door and a freezer door, respectively. Some refrigerators include intermediate storage compartments (e.g., beverage storage compartment) in the fresh food compartment and accessible without opening the fresh food compartment door. For example, a separate access door may be mounted to the fresh food compartment door, and such access door normally closes a front access opening in the fresh food door. The intermediate storage compartment, sometimes referred to as a refreshment center, is accessible by opening the access door.

It would be desirable to improve the appearance, performance, and usefulness of refreshment centers. Of course, in making such improvements, the costs associated with fabrication and assembly of such centers cannot become excessive. For example, in at least some known refreshment centers, the access door is bulky and is not easy to open. Further, the hinge systems used with some known access doors form a tight fit with the access door and refrigerator compartment. At least with these known configurations, the bulky door and tight fit of the hinge system are required in order to prevent significant leakage of cooled air through the access opening. The bulky door and tight fit of the hinge system, however, increase the difficulty in cleaning the refreshment center and are not aesthetically pleasing.

SUMMARY OF THE INVENTION

These and other objects may be attained by a refreshment center which has a modular construction and generally, includes a mini door and a frame. The mini door is fabricated and assembled separate from frame, and the mini door includes a hinge system and a trigger latch. The mini door is sized to be mated with a door flange, or trim, and provides quick and convenient access to the refreshment center by being simple and easy to open and close. Further, the mini door is light weight and the hinge system reduces the free drop open speed for quality and safety. When the mini door is in the fully opened position, the mini door provides a surface for simple snack or drink preparation. Also, the mini door hinge system allows easy access for cleaning hard to reach areas. Further, by controlling the gaps between the mini door edges and the surrounding frame, the mini door has an aesthetically pleasing appearance.

The frame, in an exemplary embodiment, is a one piece plastic molded part which serves as the main structural member of the refreshment center. The frame includes first and second spaced apart planar members, and further includes a keeper slot and a keeper for being inserted within the slot. The keeper extends from the slot and at least partially through a keeper slot in the door flange. The frame further includes a switch cavity for housing at least a portion of a switch assembly. A switch bracket is provided to be secured over the switch cavity and is engaged to the frame by a bolt.

The mini door is secured to the frame by the hinge system. The hinge system includes hinge arms which extend between, and are secured to, the mini door and the frame. More specifically, at the frame, the hinge arms are secured to slides located between the first and second planar members of the frame. Hinge pins are secured to the mini door outer door member and extend from the outer door member and through the bushings of pivot slides. The pivot slides are secured to the frame by retainers, and springs are provided to maintain the pivot slides in position within the retainer The switch assembly includes a switch having a switch actuator arm. Wires extend from the switch to a harness which mates with a receptacle. The receptacle is in electric circuit with a light in the fresh food compartment. The light used to illuminate refreshment center can be one of the existing lights used in current side-by-side refrigerators. Therefore, there is no need for a separate lamp to illuminate the refreshment center, which is believed to reduce the costs and increase the efficiency of a refrigerator incorporating the refreshment center.

The switch assembly also includes a switch actuator having an actuator arm and an actuator block. The actuator arm extends through an opening in a rib between the first and second planar members of the frame. The switch arm extends to a position over the actuator block. When the door is opened, the actuator block rests on the rib and does not engage the switch arm of the switch. As a result, the switch is closed and the fresh food compartment light is energized. As the door is closed, the slide drives the actuator upward so that the actuator block engages and pushes against the switch arm. When the switch arm is so engaged, the switch opens thereby opening the circuit between the switch and the fresh food compartment light.

As explained above, and for ease of fabrication and assembly, the refreshment center also is modular and easy to install. Specifically, the frame and the mini door are separately fabricated and provided for assembly as preassembled modules. The modular construction is believed to reduce the amount of labor required in the assembly process. In addition, good cold storage temperatures are maintained and controlled in the above described refreshment center by venting and guiding cold air from the freezer compartment into the refreshment center chamber. The chamber is enclosed by the inner cover which serves as a separation baffle and encloses the refreshment center space. Also, by eliminating metal hinges and replacing such metal hinges with small metal pivot pins that do not wick heat energy in or out of the refreshment center space, it is believed that refreshment center also is energy efficient.

DETAILED DESCRIPTION

An exemplary embodiment of a refreshment center is described below in detail in connection with a side-by-side household refrigerator. Side-by-side household refrigerators are commercially available from General Electric Company, Louisville, Ky., 40225, and such refrigerators can be modified to incorporate the refreshment center. The refreshment center, of course, can be used in many other models and types of refrigerators other than the specific side-by-side refrigerator described herein.

Figure 1:
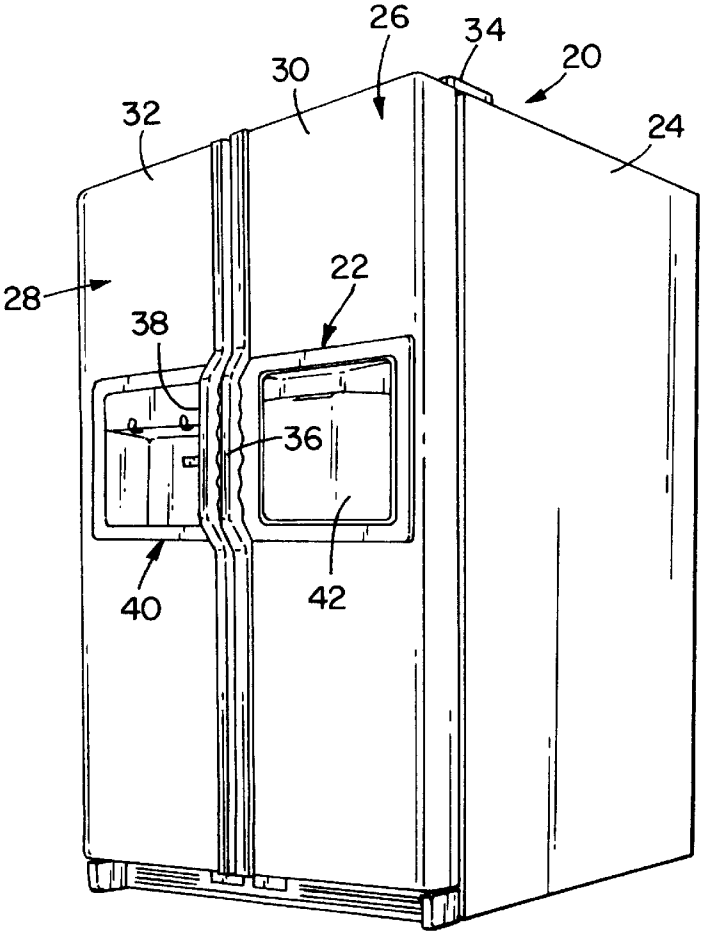
FIG. 1 is a perspective view of a side-by-side refrigerator including a refreshment center in accordance with one embodiment of the present invention.

FIG. 1 is a perspective view of a side-by-side refrigerator 20 including a refreshment center 22 in accordance with one embodiment of the present invention. Refrigerator 20 includes a cabinet 24 having a fresh food storage compartment 26 and a freezer storage compartment 28 arranged in a side-by-side configuration. Each storage compartment 26 and 28 has a front access opening normally closed by a fresh food door 30 and a freezer door 32, respectively. Each door 30 and 32 is secured to compartment cabinet 24 by a hinge 34, and handles 36 and 38 are mounted to each door 30 and 32 to facilitate door opening. Freezer door 32 includes a through-the-door dispensing mechanism 40 for dispensing, for example, ice and water. In accordance with the present invention, refrigerator 20 also includes refreshment center 22 accessible through an access opening in fresh food door 30. The access opening is closed by a mini door 42.

Figure 2:
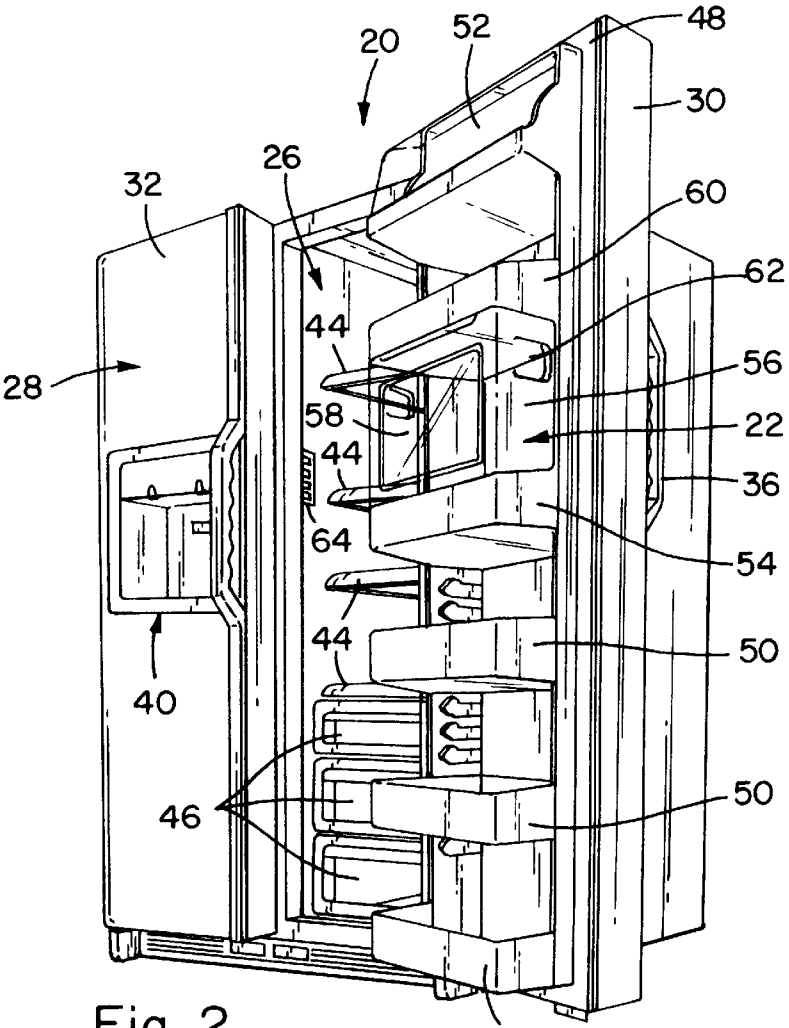
FIG. 2 is a perspective view of the refrigerator shown in FIG. 1 with the fresh food compartment door open.

FIG. 2 is a perspective view of refrigerator 20 with fresh food compartment door 30 open. Fresh food compartment 26 has adjustable shelves 44 and lower drawers 46. In addition, an inner member 48 of fresh food door 30 supports shelves 50 and a butter or cheese compartment 52. Freezer compartment 28 typically includes shelves and baskets to store items and the inner member of freezer door 32 supports shelves to store additional items.

Refreshment center 22 includes a shelf 54 which receives an inner cover 56. An access opening cover 58 is secured to inner cover 56, and access opening cover 58 is hingedly secured to inner cover 56 so that access opening cover 58 can be rotated relative to inner cover 56 to allow access to items stored on shelf 54. Inner cover 56, along with shelf 54 and shelf 60, define an area or chamber for the storage of items within refreshment center 22. Items stored within this area are accessible through mini door 42 (FIG. 1). In addition, when fresh food door 30 is opened, items within this area are accessible through access opening cover 58. Also, items within fresh food compartment 26 are accessible through mini door 42 and access opening cover 58 when fresh food door 30 is closed.

To cool items stored in the refreshment center chamber, an air flow opening 62 is provided in inner cover 56, and when fresh food door 30 is closed, air flows through opening 62 and into the refreshment center chamber from a vent 64 in flow communication with freezer compartment 28. A damper may be located in vent 64 to control the flow of cooler freezer air to within the refreshment center.

Figure 3:
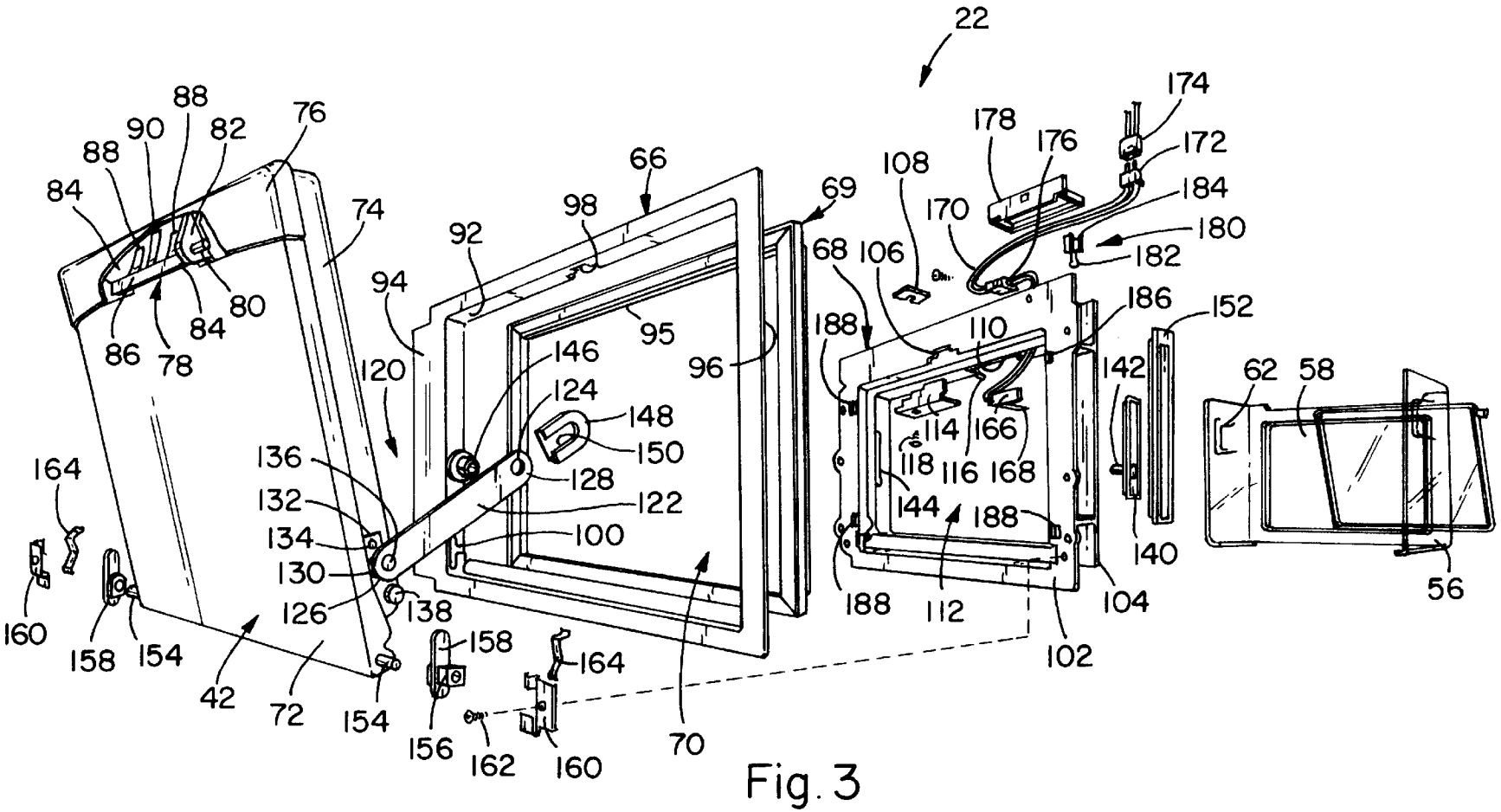
FIG. 3 is an exploded view of components of the refreshment center shown in FIG. 1.

FIG. 3 is an exploded view of components of refreshment center 22. Generally, refreshment center 22 includes mini door 42, a door flange or trim 66, a frame 68, a gasket 69, and inner cover 56. Mini door 42 and door trim 66 are generally positioned at the external surface of cabinet 28 and frame 68 and inner cover 56 are positioned within cabinet 24. An access opening 70 is provided so that a user, when mini door 42 is open, can access items stored in refreshment center 22.

Mini door 42 includes an outer door member 72 and an inner door member 74. Inner door member 74 to sized to partially extend through opening 70. A handle 76 is secured to outer door member 72, e.g., by a slip fit with notch engagement, and a trigger 78 is secured to outer door member 72 by hinge pins 80 which extend through opening 82 in flanges 84 of handle 76. Trigger 78 includes a grip 86, leaf springs 88, and a pusher member 90 which, as described below in more detail, cooperate to provide for easy opening and closing of mini door 42.

Door trim 66 includes an inner flange 92 sized to extend around the periphery of access opening 70 and an outer flange 94 which extends substantially flush with the outer surface of door 30. Gasket 69 includes an inner surface 95 which forms a tight fit around trim inner flange 92. Trim 66 is snap fit into place on door 30. Specifically, pins (not shown) extend from an inner surface 96 of outer flange 94 and such pins align with clips in door 30. When snapped into place, trim 66 is securely held in place and supported by door 30. Door trim 66 also includes a keeper slot 98 and pivot slots 100 which, as described below in more detail, facilitate opening and closing of mini door 42.

Frame 68 is a one piece plastic molded part which may be molded, for example, from ABS plastic (type Hybrid B) commercially available from Monsanto Company, St. Louis, Mo. Frame 68 includes first and second spaced apart planar members 102 and 104. A keeper slot 106 is located in first member 102 and a keeper 108 is provided for being inserted within slot 106. Keeper 108 extends from slot 106 and at least partially through keeper slot 98 in door trim 66. Frame 68 further includes a switch cavity 110 for housing at least a portion of a switch assembly 112. A switch bracket 114 is provided to be secured over opening 116 of switch cavity 110 and is engaged to frame 68 by a screw 118.

Mini door 42 is secured to frame 68 by a hinge system 120 which includes hinge arm 122 which extends from mini door 42 to frame 68. Specifically, hinge arm 122 has two ends 124 and 126, and openings 128 and 130 are formed in respective ends 124 and 126. A bracket 132 is secured to inner door member 74 by a screw 134 and a stop member 138, and hinge arm is secured to bracket 132 by a rivet 136. Stop member 138 limits the rotation of mini door 42 by engaging hinge arm 122 once mini door 42 has been rotated to the fully open position. Although not shown in FIG. 3, a similar hinge arm assembly is secured to the opposing side of inner door member 74.

Hinge arm 122 also is secured to a slide 140 located between first and second planar members 102 and 104 of frame 68. Specifically, a stud 142 extends through second opening 128 in hinge arm 122, through a slide slot 144 in frame 68, through a nut 146, and into threaded engagement with slide 140. A connector cap 148 with a slot 150 formed therein is slid over second end 124 of hinge arm 122 and covers the head of nut 146. A cap 152 is positioned over slide 140 and cap 152 prevents foamed-in-place insulation from filling the space in which slide 140 is required to move to allow opening and closing of mini door 42.

Hinge pins 154 (only one hinge pin 154 is shown in FIG. 3) are secured to mini door outer door member 72 and extend from outer door member 72 and through bushings 156 of pivot slides 158. Pivot slides 158 are secured to frame 68 by retainers 160 bolted by bolts 162 to frame 68, and springs 164 are provided to maintain pivot slides 158 in position within retainer 160 as described below in more detail.

Switch assembly 112 includes a switch 166 having a switch arm 168. Wires 170 extend from switch 166 to a harness connector 172 which mates with a receptacle 174. Receptacle 174 is in electric circuit with a light in fresh food compartment 26. The light used to illuminate refreshment center 22 can be one of the existing lights used in current side-by-side refrigerators since inner cover 56 is transparent. Therefore, there is no need for a separate lamp to illuminate refreshment center 22, which is believed to reduce the costs and increase the efficiency of a refrigerator incorporating refreshment center 22.

Wires 170 extend through a spacer member 176 configured to be inserted into, and securely held within, a slot (not shown) in frame 68 formed by ribs (not shown) extending between first and second planar members 102 and 104. A switch cover 178 is sized to be inserted between first and second planar members 102 and 104 and over switch 166 so that foamed-in-place insulation does not fill up cavity 110 and prevent proper operation of switch 166.

Switch assembly 112 also includes a switch actuator 180 having an actuator arm 182 and an actuator block 184. Actuator arm 182 extends through an opening in a rib 186 between first and second planar members 102 and 104. Arm 168 extends to a position below actuator block 184.

When door 42 is open, actuator block 184 rests on rib 186 and does not engage switch arm 168. As a result, switch 166 is closed and the fresh food compartment light is energized As door 42 is closed, bolt 142 slides upward within slide slot 144 in frame 68 and slide 140 moves upward with bolt 142. As slide 140 moves upward, slide 140 drives actuator 180 upward so that actuator block 184 engages and pushes against switch arm 168. When switch arm 168 is so engaged, switch 166 opens thereby opening the circuit between switch 166 and the light positioned in fresh food compartment 26.

With respect to securing frame 68 within fresh food door 30, first planar member 102 is configured to be positioned against the inner surface of the outer door wall of door 30 and at least is initially loosely secured thereto by plastic push-in headed studs which are pushed through openings in the outer metal wall of fresh food door 30. Specifically, the studs are pushed through the outer wall and openings 188 in frame 68 are aligned with the studs. Frame 68 is then pushed onto the studs so that the studs are at least partially inserted into frame openings 188. Once frame 68 is so positioned, aluminum tape is applied across the interface between the surfaces of first planar member 102 and the inner surface of the door outer wall. The aluminum tape seals against foam leaks flowing perpendicular to the frame edges. The aluminum tape also serves as a heat conductor to prevent or reduce external sweat on frame 68 in high temperature, high humidity kitchens.

Foam blocks are then positioned between frame 68 and the door side flanges near the frame top corners. The foam blocks separate and vent the flow of foam coming from above and below frame 68. Once the foam is poured onto the inner surface of the outer fresh food door wall above and below the framed opening, the foam fixture closes down over second planar member 104 of frame 68. As the foam fixture lid closes, the top side metal inner support is dropped into the correct location and position. The foam expands, including into spaces between first and second planar members 102 and 104, and securely holds frame 68 between the outer and inner walls of fresh food door 30.

Frame 68 may include ridges and cavities molded into first and second planar members 102 and 104. The cavities serve as collectors and traps for small amounts of foam that may squeeze through between any spaces along the joints where the frame faces lay against fresh food outer door wall. As the foam flow is restricted by a first ridge, it will be slowed or stopped. The small amount of foam that squeezes through then will freeze off upon entering the cavities with more room to increase flow or growth after the flow restriction.

Figure 4:
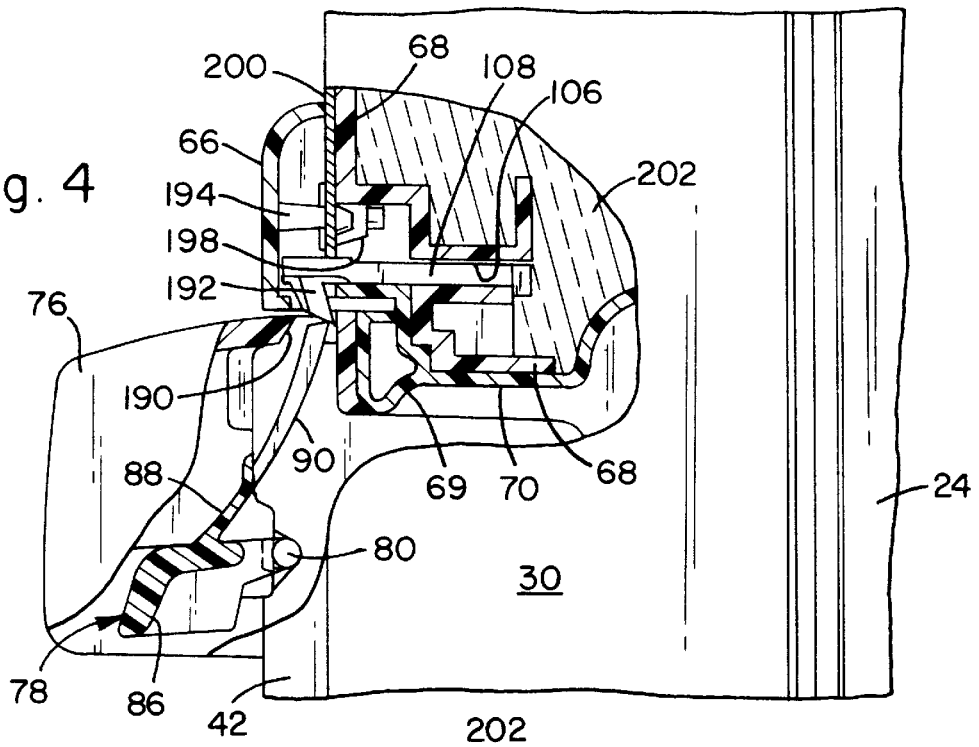
FIG. 4 is a partial cross-sectional view through a section of the refreshment center shown in FIG. 1 and illustrating the latch mechanism.

FIG. 4 is a partial cross-sectional view through a section of refreshment center 22 shown in FIG. 3 and illustrating cooperation between trigger 78 and keeper 108. As described above, trigger 78 includes leaf springs 88 and push member 90. Push member 90 extends through an opening 190 in handle 76 and into contact with a keeper arm 192 of keeper 108. Keeper 108 is snapped into slot 106 in frame 68.

When a user pulls grip 86, trigger 78 rotates on pin 80 and push member 90 forces keeper arm 192 out of opening 190 so that mini door 42 can be rotated away from keeper 108. When door 42 is closed, keeper arm 192 snaps over handle opening 190 and keeper 108 maintains door 42 closed until a user once again pulls grip 86. Trigger 78 is simple to operate with low release and keeper 108 forces. Trigger 78 therefore is believed to be easy to use by children and elderly users.

As also shown in FIG. 4, pins 194 extend from an inner surface 196 of door trim 66 and such pins 194 snap into engagement with receptacles 198 in outer wall 200 of fresh food door 30. Foamed-in-place insulation 202 also is shown in FIG. 4 and at least partially illustrates the manner in which frame 68 is securely held in place in door 30.

Figure 5:
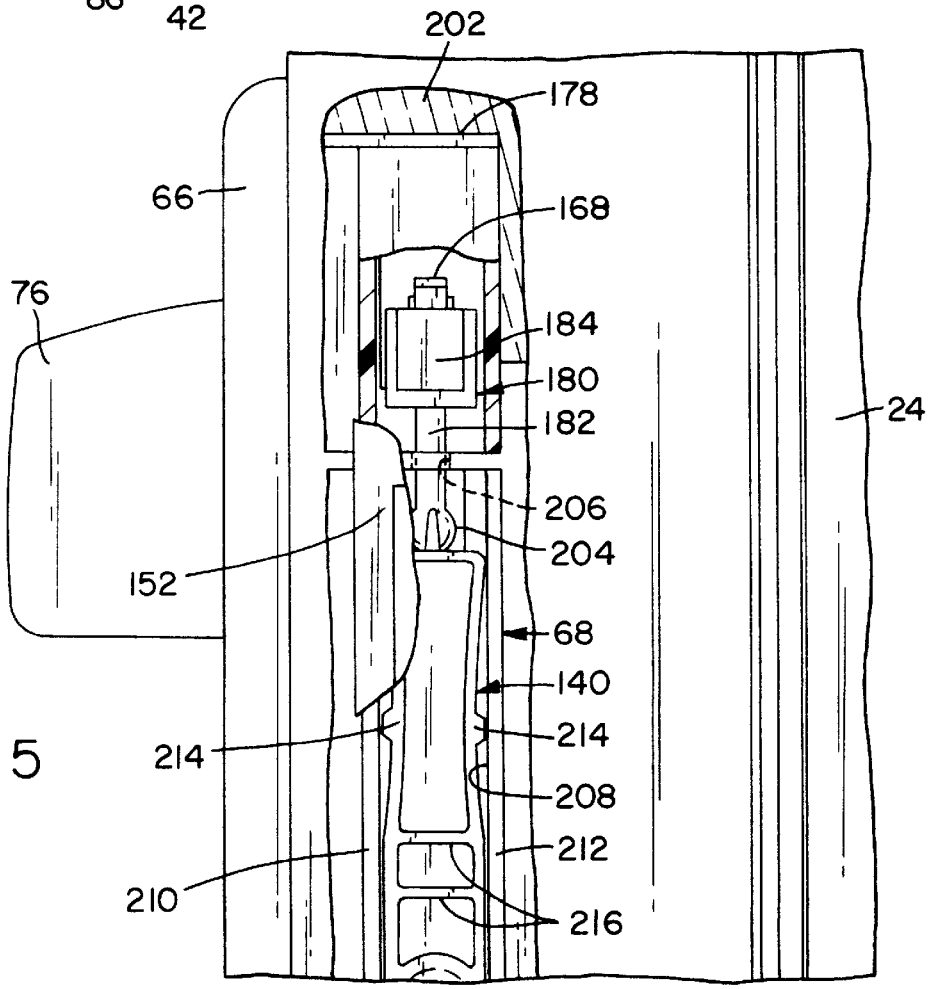
FIG. 5 is a partial cross-sectional view through a section of the refreshment center shown in FIG. 1 and illustrating the light actuation system.

FIG. 5 is a partial cross-sectional view through a section of refreshment center 22 and illustrating the light actuation system. As described above, switch assembly 112 includes switch 166 having switch arm 168. Switch 166 is electrically connected in parallel with a fresh food compartment door switch (not shown) to a light positioned in the fresh food compartment. Generally, when the fresh food compartment door is opened, the fresh food compartment door switch closes so that the light is energized, and when the fresh food compartment door is closed, the circuit between the door switch and the light is opened. Similarly, and with respect to switch 166, when mini door 42 is opened, switch 166 closes so that the light is energized, and when mini door 42 is closed, switch 166 opens so that the circuit between switch 166 and the light is opened.

As shown in FIG. 5, arm 168 extends over actuator block 184 of switch actuator 180. When door 42 is closed, actuator block 184 engages switch arm 168 and switch 166 is open. When door 42 is opened, and as slide 140 moves downward, actuator block 184 rests on rib 186 and does not engage switch arm 168. As a result, switch 166 is closed and the fresh food compartment light is energized.

An actuator ball 204 of actuator arm 182 makes contact with slide 140. Actuator arm 182 extends through an opening 206 in rib 186 so that ball 204 may contact slide 140. Slide 140 is located in a slide slot 208 formed by elongate members 210 and 212 of frame 68. Guides 214 contact members 210 and 212 and stiffening ribs 216 extend between members 210 and 212, to provide more controlled opening and closing of door 42.

Figure 6:
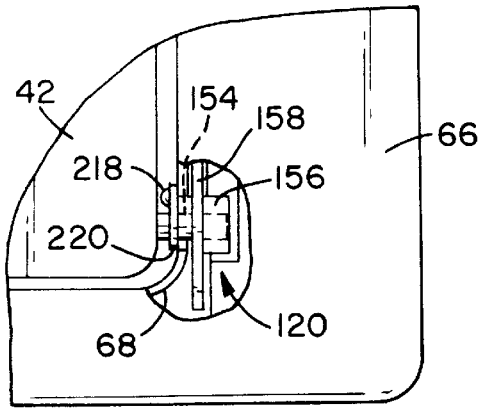
FIG. 6 is a partial cross-sectional view through a section of the refreshment center shown in FIG. 1 and illustrating a portion of the hinge system.

FIG. 6 is a partial cross-sectional view through a section of refreshment center 22 and illustrating a portion of hinge system 120. As shown in FIG. 6, hinge pin 154 extends from outer door member 72 and into bushing 156 of pivot slide 158. Bushing 156 is located in pivot slot 100 in frame 68, and as described below in more detail, bushing 156 travels within slot 100 when mini door 42 is moved to a cleaning position. Of course, hinge pin 154 rotates relative to bushing 156 when mini door 42 is opened and closed. A spacer 218 extends from a flange 220 of pivot slide 158, and spacer 218 ensures proper spacing between mini door 42 and pivot slide 158.

Hinge system 120 provides that mini door 42 is easy to open and can serve as a stable flat service for pouring drinks or preparing snacks. Also, hinge system 120 is mostly internally located within refreshment center 22 to reduce the possibility of pinching. Further, by minimizing the number of metal fasteners used in connection with mini door 42 the amount of heat conducted into refreshment center cavity is believed to be low. In addition, hinge system 120 provides a flush finished appearance between mini door 42 and refrigerator fresh food door 30.

Figure 7:
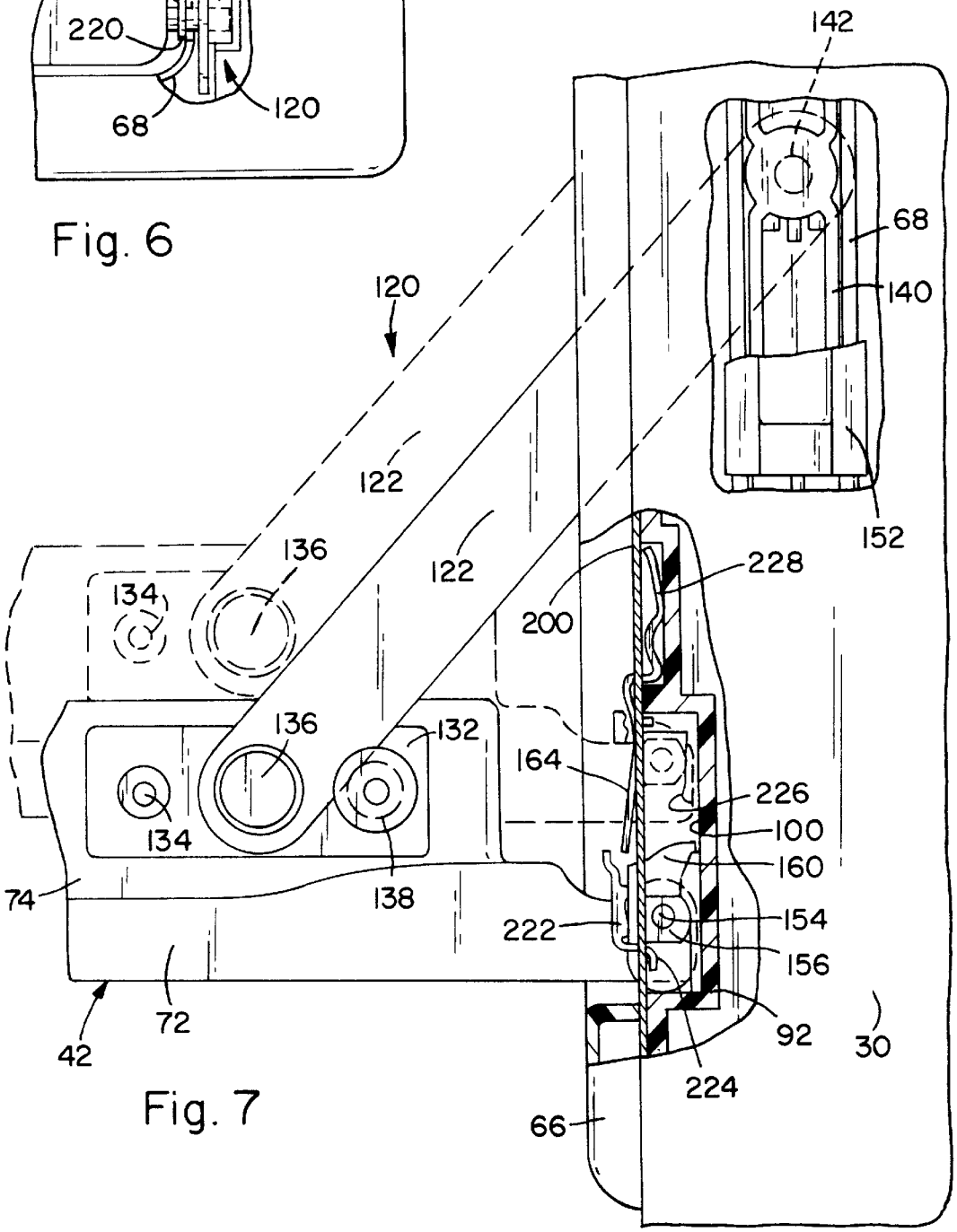
FIG. 7 is a partial cross-sectional view through a section of the refreshment center shown in FIG. 1 and illustrating the hinge system.

FIG. 7 is a partial cross-sectional view through a section of refreshment center 22 and illustrating hinge system 120. In FIG. 7, mini door 42 is shown in the fully opened normal operating position in solid lines and in a cleaning position in phantom. As described above, hinge arm 122 extends between, and is coupled to, mini door 42 and frame 68. Stop 138 prevents rotation of mini door 42 beyond the illustrated fully opened position by limiting movement of hinge arm 122 beyond the position as shown. Further, a spring retainer 222 is secured to outer wall 200 of door 30 by extending a lip 224 of retainer 222 through a slot in wall 200. Spring retainer 222 facilities maintaining retainer in position with respect to pivot bushing.

To move mini door 42 to the cleaning position, door 42 is fully opened as illustrated in solid lines and then pushed upward. As door 42 is pushed upward, slide 140 travels upward along with arm 122 and pivot bushing 156 travels upward in pivot slot 100. As bushing 156 travels upward, it snaps over a retainer flange 226 in slot 100 and is held over flange 226 by spring 164. An arm 228 of spring 164 is trapped between outer wall 200 of fresh food door 30 and frame 68 so that spring 164 is securely held in place. By pushing against bushing 156, spring 164 facilitates maintaining bushing 156 above retainer flange 226 while an operator cleans the space between mini door 42 and trim 66. Once the desired cleaning is completed, the operator simply pushes downward on mini door 42 with sufficient force to overcome the retention force of spring 164 and so that bushing 156 snaps over retainer flange 226. Pivot bushing 156 then travels downward and back into retainer 160 for normal operations. Enabling such easy cleaning of typically difficult to reach areas is believed to be pleasing to users and enhances the appearance of refreshment center 22.

Figure 8:
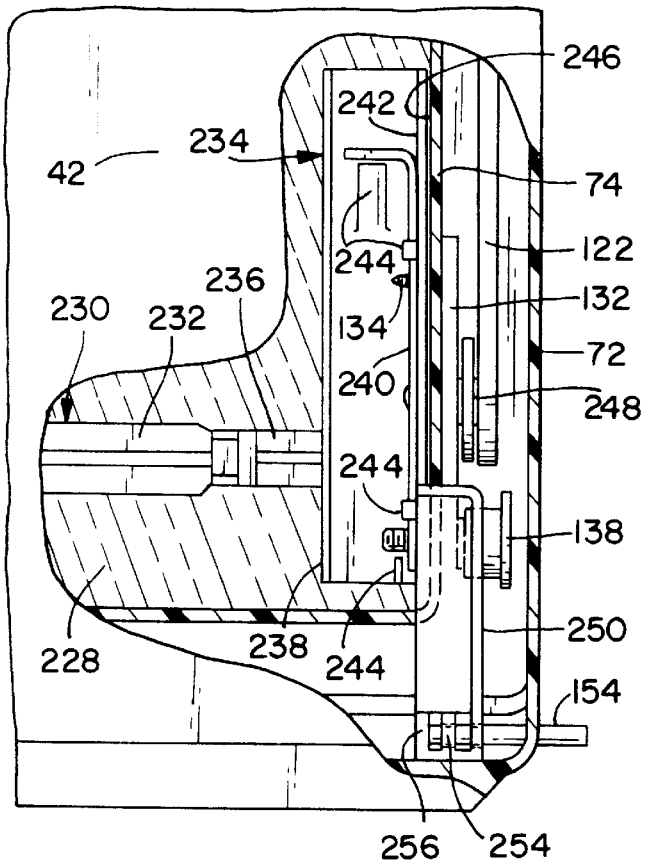
FIG. 8 is a partial cross-sectional front view through a section of the mini door.

FIG. 8 is a partial cross-sectional front view through a section of mini door 42. As clearly shown in FIG. 8, mini door 42 is filled with foamed-on-place insulation 228. An internal bracket assembly 230 is located within the chamber defined by inner door member 74, and internal bracket assembly 230 includes a bar 232 which extends substantially across the entire length of inner door member 74. At each opposing end of bar 232 (only one end of bar is shown in FIG. 8), a retainer assembly 234 is provided. Retainer assembly 234 is secured to bar 232 by a slide member 236 which is movable relative to bar 232 to enable automated location of internal bracket assembly 230 within the inner door member chamber as described below. Retainer assembly 230 includes a channel member 238, and metal nut strip 240 is secured to a chamber wall 242 by positioners 244. When retainer assembly 234 is slid into contact with an inner surface 246 of inner door member 74, metal nut strip 240 provides a backing for bolt 134 and stop 138 which extend through inner door member 74 and engage bracket 132 to inner door member 74.

As also shown in FIG. 8, a plastic spacer 248 is provided between hinge arm 122 and bracket 132 to enable low friction movement of hinge arm 122 relative to mini door 42. Further, a hinge pin extension 250 extends from channel member 238 and is provided to securely retain hinge pin 154 in place. Specifically, hinge pin 154 is secured to outer door member 72 and extends through openings in outer door wall 252, extension and a rib 254. Hinge pin 154 abuts against a rib 256, and in this manner, hinge pin 154 is securely held in place.

Figure 9:
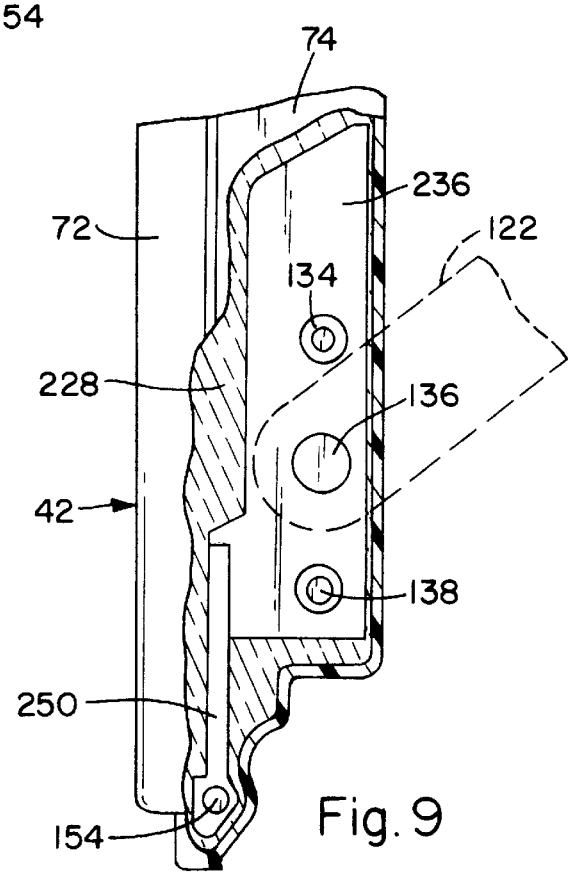
FIG. 9 is a partial cross-sectional side view through a section of the mini door.

FIG. 9 is a partial cross-sectional side view through a section of mini door 42. Bolts 134 and 138 extend into nut strip 240 and securely maintain bracket 132 in place. In addition, extension 250 from channel member 236 is provided to add extra strength for maintaining hinge pin 154 in place.

Mini door 42 is fabricated using substantially automated processes combined with a twin sheet thermoforming process. Specifically, a mold is provided to form the interior cavity of inner door member 74 using a plug assist and vacuum forming process. That is, a heated plastic sheet (e.g., ABS type 752 and/or Centrex 833, commercially available from the Monsanto Company) is located between a lower tool and plug, and the lower tool is moved upward toward the plug so that the plug forces the heated plastic metal sheet to conform to the cavity defined by the tool. Bracket assembly 230 is located within channels in the plug, and once the plug deforms the plastic sheet to the lower tool defined cavity, bracket assembly 230 is expanded in the cavity so that retainer assembly 234 is located as shown in FIG. 8. Specifically, retainer assembly 234 is ratcheted out and cannot be retracted without excessive force. The assembly also is maintained in place by protrusions/bumps cammed into the interior portion of the thermoformed surface over which the retainer is expanded. Extension 250 also cooperates with inner door member 74 to facilitate retaining assembly 230 in place. The plug is then removed from within the cavity. Outer door member 72 is molded from a plastic sheet (e.g., ABS type 752 and/or Centrex 833) using an upper tool and vacuum assist, and once outer door member 72 is formed, the lower tool is raised up to the upper tool and a heat weld is formed between inner door member 74 and outer door member 72. During the welding process, the edges are trimmed and deburred (i.e., flash is removed), and the assembly is then located in a fixture so that holes can be drilled into the sides of inner door member 74 and channel member 238 for bolt 134 and stop 138. Hinge arm 122 is then installed. Vent holes may then be drilled in the assembly and insulation foam is then injected into the chamber defined by outer and inner door members 72 and 74. The foam is allowed to stabilize for approximately about twenty-four hours. The assembly is then transported to a hinge pin drilling station, and the hinge pin holes are then drilled into outer door member 72, extension 250, and rib 254. Excess material also is routed off at this time. Hinge pins 154 are then press fit into position as shown in FIG. 8. Trigger 78, handle 76, pivot slides 158, and trim 66 are then secured to the door assembly, and a gasket is secured (e.g., taped) to door 42. Nuts 146 and connector caps 148 also are secured to hinge arm 122. For shipping, a spacer is located between trim 66 and door 42 to facilitate assembling mini door 42 to frame 68.

As described above, by enabling separate fabrication of mini door 42 from frame 68, mini door 42 can be substantially independently fabricated and delivered to the assembly site for installation into a refrigerator. Such modular assembly provides many advantages as discussed above.

Figure 10:
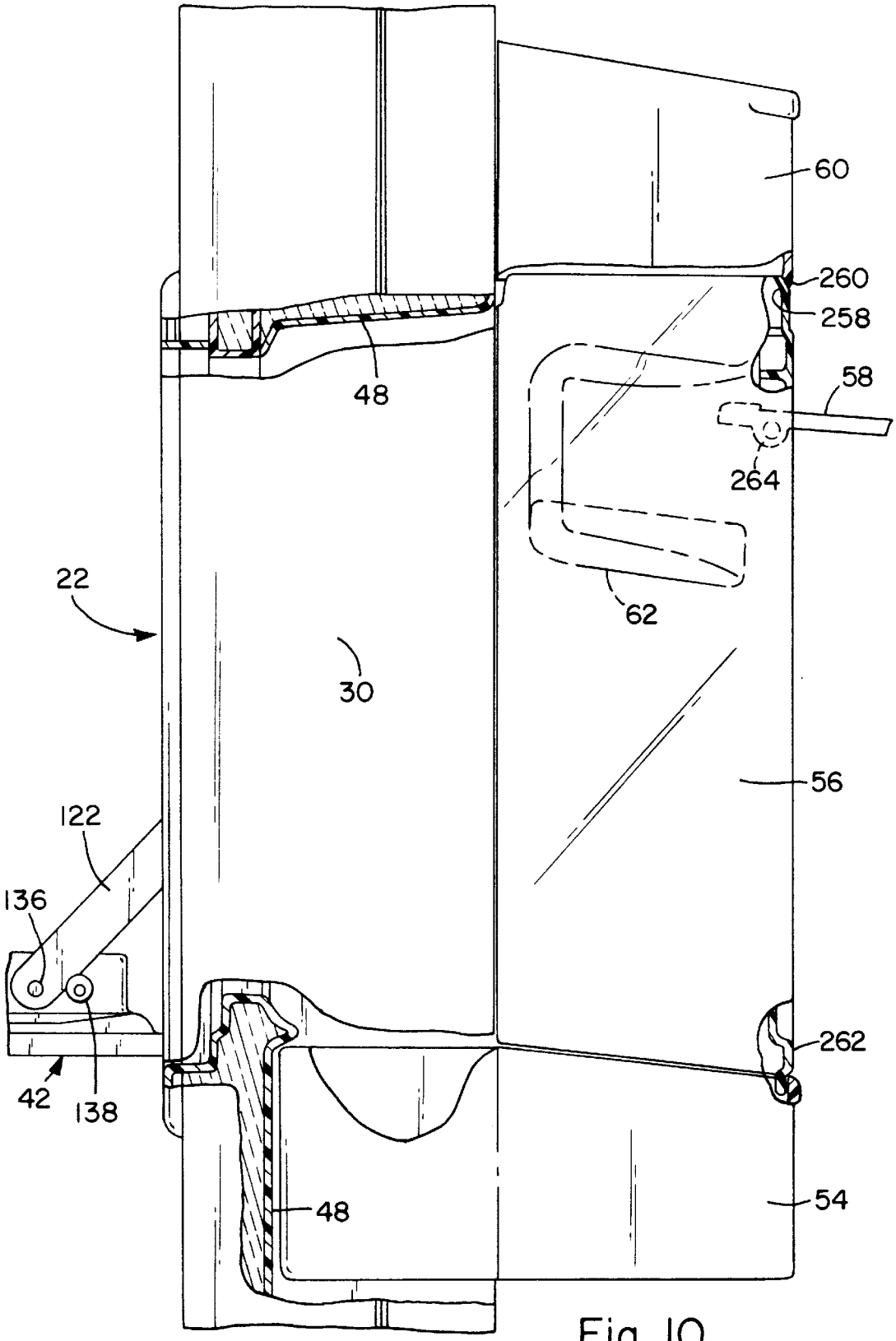
FIG. 10 is a side view of a portion of the assembled refreshment center.

FIG. 10 is a side view of a portion of assembled refreshment center 22. As shown in FIG. 10, inner cover 56 includes top side flaps 258 that fit into pockets 260 in a bottom portion of shelf 60. Inner cover 56 also includes lower flanges 262 that cooperate with shelf 54 to maintain inner cover 56 in position. Access opening cover 58 is hingedly secured, by integral hinge pins 264, to inner cover 56 so that access opening cover 58 can be rotated relative to inner cover 56 to allow access to items stored on shelf 54. Inner cover 56, along with shelf 54 and shelf 60, define the refreshment center storage chamber for the storage of items within refreshment center 22. Items stored within this chamber are accessible through mini door 42. In addition, when fresh food door 30 is opened, items within this chamber are accessible through access opening cover 58. Air flow opening 62 is provided in inner cover 56, and when fresh food door 30 is closed, air flows into the refreshment center chamber from vent 64 in flow communication with freezer compartment 28.

Inner cover 56 reduces the loss of chilled air when mini door 42 is opened and closed. In addition, inner cover 56 facilitates the collection of cold air from the freezer compartment to lower and improve temperature maintenance in the refreshment center compartment.

The above described refreshment center is believed to provide many advantages over known centers. For example, the mini door provides quick and convenient access by being simple and easy to open and close. Further, the mini door is light weight and the hinge system reduces the free drop open speed for quality and safety. When the mini door is in the fully opened position, the mini door provides a surface for simple snack or drink preparation. The mini door work surface may be contoured to facilitate catching spills. Also, the mini door hinge system allows easy access for cleaning hard to reach areas. Further, by controlling the gaps between the mini door edges and the surrounding frame, the mini door has an aesthetically pleasing appearance.

For ease of fabrication, the refreshment center also is modular and easy to install. Specifically, the mini door frame and the mini door can be separately fabricated and provided for assembly as pre-assembled modules. The mini door frame assembly can be pre-assembled except for the keeper. The mini door, trim and gasket assembly also are pre-assembled. Just prior to final fresh food door assembly, the latch keeper is located in the slot in keeper slot and the mini door is assembled to the mini door frame previously foamed-in-place. This modular construction is believed to reduce the amount of labor required in the assembly process.

Moreover, good cold storage temperatures are maintained and controlled by venting and guiding cold air from the freezer compartment into the refreshment center chamber. The chamber is enclosed by the inner cover which serves as a separation baffle and encloses the refreshment center space. The inner cover can be easily and quickly installed without requiring the removal of any shelves on the inner door member. By eliminating metal hinges and replacing such metal hinges with small metal pivot pins that do not wick heat energy in or out of the refreshment center space, it is believed that refreshment center also is energy efficient. Also, the trigger, latch, and handle are metal and fastener free, which provides additional energy savings.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

We claim:

1. A side-by-side refrigerator comprising a cabinet having a fresh food storage compartment and a freezer storage compartment, said fresh food storage compartment comprising a front access opening normally closed by a fresh food door, and a refreshment center accessible through an access opening in said fresh food door, said refreshment center comprising a modular mini door for closing said access opening in said fresh food door, a frame secured between outer and inner walls of said fresh food door, and a hinge system for securing said mini door to said frame.

2. A refrigerator in accordance with claim 1 wherein said refreshment center further comprises an inner cover and a shelf, said inner cover supported by said shelf and comprising an access opening, an access opening cover secured to said inner cover and normally closing said access opening cover.

3. A refrigerator in accordance with claim 2 wherein said inner cover further comprises an air flow opening therein so that air may flow into a refreshment center chamber from a vent in flow communication with said freezer compartment.

4. A refrigerator in accordance with claim 1 further comprising door trim secured to said fresh food door at said access opening in said fresh food door.

5. A refrigerator in accordance with claim 1 wherein said mini door comprises an outer door member and an inner door member, said inner door member sized to partially extend through said access opening in said fresh food door.

6. A refrigerator in accordance with claim 5 further comprising a handle secured to said outer door member and a trigger secured to said outer door member, said trigger comprising a grip, at least one leaf springs, and a pusher member.

7. A refrigerator in accordance with claim 1 wherein said frame comprises first and second spaced apart planar members, a keeper slot in first member, and a switch cavity for housing at least a portion of a switch assembly.

8. A refrigerator in accordance with claim 1 wherein said hinge system comprises a hinge arm secured to said mini door and to said frame.

9. A refrigerator in accordance with claim 8 comprising a bracket secured to said mini door, and said hinge arm is secured to said bracket, said hinge system further comprising a stop member secured to said bracket and positioned to limit rotation of said mini door.

10. A refrigerator in accordance with claim 8 wherein said hinge arm is secured to a slide located between said first and second planar members of said frame, and a cap positioned over said slide.

11. A refrigerator in accordance with claim 8 wherein said hinge system further comprises hinge pins secured to said mini door, and pivot slides secured to said frame, said pivot slides comprising bushings, and said hinge pins extending into respective bushings.

12. A refrigerator in accordance with claim 1 further comprising a switch assembly comprising a switch having a switch arm, said switch in electric circuit with a light, and a switch actuator having an actuator arm and an actuator block.

13. A method for fabricating a refreshment center for a refrigerator comprising a cabinet having a fresh food storage compartment and a freezer storage compartment, said method comprising the steps of:

fabricating a fresh food door having a refreshment center frame between inner and outer walls of the door;

fabricating a mini door for closing an access opening defined by the refreshment center frame; and securing the mini door to the frame.

14. A method in accordance with claim 13 wherein fabricating the fresh food door comprises the steps of:

positioning a first planar member of the frame on an inner surface of an outer door wall of the door;

locating aluminum tape across interfaces between the first planar member and the inner surface of the door outer wall;

positioning foam blocks between the frame and the door side flanges;

pouring foam onto the inner surface of the outer fresh food door wall above and below the framed opening;

closing a foam fixture over a second planar member of the frame and, as the foam fixture lid closes, locating a top side metal inner support over the frame.

15. A method in accordance with claim 13 wherein fabricating the mini door comprises the steps of:

molding an inner door member using a plug assist and vacuum forming process;

molding an outer door member using a vacuum forming process;

heat welding the inner door member to the outer door member.

16. A method in accordance with claim 15 further comprising the step of locating a bracket assembly in the inner door member.

17. A method in accordance with claim 15 further comprising the step of injecting insulation foam into a chamber defined by the outer and inner door members.

18. A method in accordance with claim 17 further comprising the step of drilling hinge pin holes in the outer door member and press fitting hinge pins into the outer door member.

19. A method in accordance with claim 15 further comprising the steps of assembling a trigger and a handle to the mini door.

20. A mini door for a refreshment center of a refrigerator, the refrigerator having a fresh food door with an access opening therein, said mini door comprising:

an outer door member and an inner door member, said inner door member sized to partially extend through an access opening in said fresh food door;

a handle secured to said outer door member; and a trigger secured to said outer door member, said trigger comprising a grip, at least one leaf spring, and a pusher member.

21. A mini door for a refreshment center of a refrigerator, the refrigerator having a fresh food door with an access opening therein, said mini door comprising:

an outer door member and an inner door member, said inner door member sized to partially extend through an access opening in said fresh food door;

a bracket secured to said inner door member;

a hinge arm secured to said bracket; and a stop member secured to said bracket and positioned to limit movement of said hinge arm.

22. A mini door for a refreshment center of a refrigerator, the refrigerator having a fresh food door with an access opening therein, said mini door comprising:

an outer door member and an inner door member, said inner door member sized to partially extend through an access opening in said fresh food door; and hinge pins secured to said outer door member.

23. A frame for a refreshment center of a refrigerator, the refrigerator having a fresh food door with an access opening therein, said frame comprising first and second spaced apart planar members and a keeper slot in said first member.

24. A frame in accordance with claim 23 further comprising a switch cavity for housing at least a portion of a switch assembly.

25. A light actuation system in a refreshment center in a fresh food compartment of a refrigerator, the refreshment center including a frame and a mini door secured to the frame by a hinge system, the hinge system including a slide which moves upward as the mini door is opened, said light actuation system comprising:

a switch comprising a switch arm, said switch being in electric circuit with a light in the fresh food compartment;

a switch actuator located over the slide so that as the slide moves upward, said switch actuator contacts said switch arm.

26. A light actuation system in accordance with claim 25 wherein said switch actuator comprises an actuator block and an actuator arm, said actuator arm extending through a rib of the frame and over the slide.

27. A light actuation system in accordance with claim 26 wherein when the mini door is opened, said actuator block rests on the rib.

28. A light actuation system in accordance with claim 26 wherein when the mini door is closed, said actuator block engages and pushes against said switch arm.

29. A hinge system for a refreshment center of a refrigerator, the refreshment center including a mini door and a frame secured between outer and inner walls of a refrigerator door, said hinge system comprising:

brackets secured to the mini door;

hinge arms secured to the mini door bracket and to the frame; and a stop member secured to said bracket and positioned to limit movement of at least one of said hinge arms.

30. A hinge system in accordance with claim 29 further comprising a slide positioned between members of the frame, said hinge arm secured to said slide.

31. A hinge system in accordance with claim 29 further comprising hinge pins secured to the mini door and pivot slides secured to the frame, said pivot slides comprising bushings, and said hinge pins extending into respective bushings.

* * * * *